US007432465B2

(12) United States Patent
Pavlovic et al.

(10) Patent No.: US 7,432,465 B2
(45) Date of Patent: Oct. 7, 2008

(54) SWITCHING DEVICE WITH A DISCONNECTION AND/OR GROUNDING FUNCTION

(75) Inventors: Bojan Pavlovic, Zürich (CH); Daniel Bleiker, Zürich (CH); Diego Sologuren-Sanchez, Wettingen (CH); Walter Holaus, Zürich (CH); Martin Wieser, Frauenfeld (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/508,945

(22) Filed: Aug. 24, 2006

(65) Prior Publication Data

US 2006/0283842 A1 Dec. 21, 2006

Related U.S. Application Data

(63) Continuation of application No. PCT/CH2005/000111, filed on Feb. 25, 2005.

(30) Foreign Application Priority Data

Feb. 27, 2004 (EP) ..... 04405113

(51) Int. Cl.
*H01H 33/70* (2006.01)

(52) U.S. Cl. ..... 218/79; 218/80

(58) Field of Classification Search ..... 218/2–7, 218/12–14, 43–45, 55–58, 67–80, 84, 153–156
See application file for complete search history.

(56) References Cited

U.S. PATENT DOCUMENTS 3,553,397 A * 1/1971 Schmitz ..... 200/48 R
3,876,846 A * 4/1975 Graybill ..... 218/68
4,107,498 A * 8/1978 Golota ..... 218/80
5,559,403 A 9/1996 Sakai et al.

(Continued)

FOREIGN PATENT DOCUMENTS

EP 2000 134733 12/2000

(Continued)

OTHER PUBLICATIONS

Okabe et al., $SF_6$-Gas-isolierte Schaltanlagen (GIS) Typ ELK, BBC Brown Boveri, pp. 8-10.

(Continued)

*Primary Examiner*—Elvin Enad
*Assistant Examiner*—Marina Fishman
(74) *Attorney, Agent, or Firm*—Buchanan Ingersoll & Rooney PC

(57) ABSTRACT

A switching device configurable as a grounding device, a disconnecting device, and a combined disconnecting/grounding device is disclosed. The switching device includes an encapsulating housing, a stationary grounding contact fixed to the housing, a stationary disconnector contact fixed to a first conductor, and a moveable contact that is movable along an axis and engagable with the grounding contact and the disconnector contact. A conductor tube is fixed to a second conductor and accommodates the moveable contact. A drive for driving the moveable contact has a retaining element that is movable along the axis and is guided in the conductor tube. The retaining element accommodates two contact tubes. A first contact tube forms a mating contact of a grounding device containing the stationary grounding contact. A second contact tube forms a mating contact of a disconnector containing the disconnector contact.

26 Claims, 3 Drawing Sheets

U.S. PATENT DOCUMENTS

| | | | | |
|---|---|---|---|---|
| 5,721,412 | A * | 2/1998 | Schifko et al. | 218/43 |
| 6,144,005 | A * | 11/2000 | Tanimizu et al. | 218/118 |
| 6,680,453 | B2 * | 1/2004 | Rokunohe et al. | 218/2 |
| 6,946,613 | B2 * | 9/2005 | Otsuka et al. | 218/79 |
| 7,122,759 | B2 * | 10/2006 | Moser et al. | 218/79 |
| 2001/0025828 | A1 | 10/2001 | Gutalj | |

FOREIGN PATENT DOCUMENTS

| | | |
|---|---|---|
| EP | 1 068 624 B1 | 1/2001 |
| EP | 1 361 633 A2 | 11/2003 |

OTHER PUBLICATIONS

Okabe et al., "Serialization of Standard Gas Insulated Switchgear", Hitachi Review, vol. 51, No. 5, 2002, pp. 169-173.

PCT Search Report dated Apr. 4, 2005.

European Search Report dated Sep. 30, 2004.

* cited by examiner

SWITCHING DEVICE WITH A DISCONNECTION AND/OR GROUNDING FUNCTION

CROSS REFERENCE TO RELATED APPLICATIONS

This application claims priority under 35 U.S.C. §119 to European Application 04405113.4 filed in EPO on 27 Feb. 2004, and as a continuation application under 35 U.S.C. §120 to PCT/CH2005/000111 filed as an International Application on 25 Feb. 2005 designating the U.S., the entire contents of which are hereby incorporated by reference in their entireties.

TECHNICAL FIELD

The invention is based on a switching device. Such a switching device can perform both disconnection and grounding functions and is used in gas-insulated, single-phase- or polyphase-encapsulated switchgear assemblies for voltages of several kV to several hundred kV. In this case, use is made of the fact that the functions of disconnection and grounding are often required at the same location in the switchgear assemblies. The switching device has an encapsulating housing, which is filled with an insulating gas, for example nitrogen, air, sulfur hexafloride ($SF_6$) alone or in a mixture, at a pressure of up to a few bar, and a grounding contact is fixed to the encapsulating housing in the interior. In addition, a disconnector contact fixed to a current conductor and a moveable contact element, which can be displaced along an axis and can be brought into or out of engagement either with the disconnector contact or with the grounding device contact, are arranged in the housing interior. In addition, a conductor tube is provided in the housing, which conductor tube is fixed so as to conduct current to a further current conductor, accommodates the moveable contact element so as to form a current transfer point and, in particular, coaxially surrounds it. The moveable contact element is driven with force by a drive guided through the housing. It is thus possible for the functions of disconnection and grounding to be realized using a single drive.

PRIOR ART

In the precharacterizing clause, the invention makes reference to a prior art of switching devices, as is known, for example, from Hitachi Review Vol. 51 (2002) No. 5 pp. 169 to 173 or from EP 1 068 624 B1. The switching devices described in these prior publications for gas-insulated, metal-encapsulated switchgear assemblies each have a three-position switch, which can perform all of the functions of a disconnecting switch and a grounding switch using a single drive. In this case, a moveable contact element, which is arranged in an encapsulating housing, is displaced along an axis, which axis is guided through a disconnector contact and through a grounding contact. With a linear movement of the contact element, three switching positions of the switching device can therefore be reached. In a first one of these three positions, the contact element is in engagement neither with the disconnector contact nor with the grounding device contact (neutral position), i.e. both an elbow disconnector integrated in the switching device and a grounding device integrated in the switching device are open. In a second position, the contact element engages in the disconnector contact. The disconnection switching point of the disconnector is now closed when the grounding device is open. In the third position, the contact element engages in the grounding contact.

The grounding device is now closed when the disconnector is open.

Drive force for the moveable contact element is transmitted transversely with respect to its movement direction. For this purpose, the encapsulating housing requires additional space transversely with respect to the axis (Hitachi Review) or a specially designed current conductor accommodating a lever transmission is required (EP 1 068 624 B1).

Document No. CH-HS 1215 87 D "SF6-Gas-isolierte Schaltanlagen (GIS) Typ ELK" [SF6 gas-insulated switchgear assemblies (GIS) of the ELK type] BBC Brown Boveri AG Hochspannungstechnik, [High-voltage engineering] CH-5401 Baden, Switzerland, describes, on page 9, an elbow disconnector switch of the ELK T type, in the case of which the moveable disconnector contact arranged in an encapsulating housing is fixed to a nut of a spindle gear. A threaded spindle of the gear is fixed to a rotary shaft guided in a gas-tight manner through the wall of the encapsulating housing. When the shaft rotates, the threaded nut and therefore also the moveable disconnector contact fixed thereto are displaced linearly in the housing and can therefore be brought into or out of engagement with a stationary mating disconnector contact arranged in the encapsulating housing. Concomitant rotation of the spindle nut is prevented by a guide rail, which is arranged in a contact carrier and is aligned in the movement direction of the moveable disconnector contact and interacts with a sliding element of the moveable contact.

DESCRIPTION OF THE INVENTION

The invention achieves the object of specifying a switching device of the type mentioned initially which can be retrofitted with little complexity such that it can perform the functions of disconnection and grounding, only disconnection or only grounding, depending on requirements.

The drive provided in the switching device according to the invention has a retaining element, which can be displaced along an axis, is guided in a conductor tube and is designed to accommodate two contact tubes, of which a first contact tube forms the mating contact of a grounding device containing the stationary grounding contact, and a second contact tube forms the mating contact of a disconnector containing the disconnector contact. In addition, a moveable contact element of the switching device comprises at least one of the two contact tubes. The moveable contact element therefore has at least one contact tube, which is connected to the retaining element and is, in particular, driven by said retaining element and which forms either the mating contact of a grounding device containing the stationary grounding contact or the mating contact of a disconnector containing the disconnector contact or both the mating contact of a grounding device containing the stationary grounding contact and the mating contact of a disconnector containing the disconnector contact. These measures make it possible to form three switching devices having the functions of disconnection and grounding, only disconnection or only grounding using only a single basic switching device. In particular, the at least one contact tube can be detachably connected or is fixedly connected to the retaining element. In the first case, the three switching devices having the functions of disconnection and grounding, only disconnection or only grounding are formed by opening or closing at most two detachable connections using only a single basic switching device. The retaining element is preferably guided axially in the conductor tube and secured radially.

If the contact element contains the two contact tubes, the switching device is in the form of a combined disconnecting and grounding switch (combination disconnector). In a gas-insulated, encapsulated switchgear assembly, the functions of disconnection and grounding can then be performed using a switching device having only a single drive. However, this means that the disconnection and grounding points in the assembly are closely adjacent to one another. If the disconnection and grounding points are far removed from one another and only a grounding or disconnection task needs to be carried out, only one of the contact tubes needs to be removed, for example by opening one of the two detachable connections, in order to therefore provide a switching device with a disconnector or grounding device function. The electrical functions of disconnection and grounding, only disconnection or only grounding can therefore be covered with a single type of switching device in gas-insulated, encapsulated switchgear assemblies. The costs associated with storage and fitting of the assembly are therefore reduced.

The switching device according to the invention has a particularly compact design if the drive has a spindle gear having a threaded spindle, which is guided axially and centrally through the grounding contact, and having a spindle nut, which supports or forms the retaining element. Drive force is now exclusively transmitted in the movement direction of the moveable contact element. No additional space is therefore required transversely with respect to the movement direction. In addition, the drive force is only transmitted from the outside through the wall of the encapsulating housing in the form of a rotating rotary movement. A shaft required for this purpose can easily be sealed off at the wall leadthrough. Since this shaft is guided essentially through the grounding contact, no further leadthrough is required beyond the wall leadthrough which is provided in any case for the grounding contact, and thus space is saved which can be used for leading through a current conductor carrying a high voltage. The spindle gear generates a linear movement of the moveable contact element only in the interior of the encapsulating housing. As a result, additional space is saved in the interior of the encapsulating housing.

The spindle nut is advantageously formed by a threaded nut and the annular retaining element, which is fixed at the outer edge of the threaded nut. Then, the retaining element can be formed independently of the threaded nut required for performing the gear function of the spindle and can easily be provided with two connecting parts, such as outer threads, for example, which are required for producing detachable connections with the two contact tubes.

The linear movement of the spindle nut and therefore also of the contact tubes is maintained by the fact that a sliding element is arranged at an outer edge of the retaining element and interacts with a guide rail, which is aligned axially in the conductor tube.

Although concomitant rotation of the spindle nut is prevented already by one or two sliding elements and the corresponding number of guide rails, it has proven to be expedient for, in addition to the one sliding element, at least two further sliding elements to also be arranged evenly distributed in the circumferential direction at the outer edge of the retaining element, which further sliding elements interact with a corresponding number of guide rails which are aligned axially in the conductor tube. These measures ensure precise and secure guidance of the contact element which is subjected to severe forces on actuation of the switching device.

If the housing has two openings, of which a first opening has the axis passing through it and serves the purpose of leading through the first current conductor, and the second opening is arranged at an angle with respect to the axis and serves the purpose of leading through the second current conductor, it is not only possible for the three electrical functions of "disconnection and grounding", "purely disconnection" or "purely grounding" to be performed using the switching device with little complexity in terms of installation, but it is then also possible for the switching device to be installed at an angle in the switchgear assembly for all three electrical functions. Combination disconnectors, disconnectors or grounding devices then act on a current path, which is guided at an angle, and the grounding device may possibly be installed in the assembly without a connection function.

The longitudinal connection function is achieved if the housing has a third housing opening, which serves the purpose of leading through a third current conductor, which is arranged in line with the second current conductor and can have a high voltage applied to it. Then, a longitudinal connection of the switchgear assembly is guided through the switching device and, in the embodiment in the form of a combination disconnector, can be connected to the first current conductor, which is guided at an angle thereto, can be disconnected therefrom or can be grounded, only in the embodiment in the form of a disconnector, can be connected to the first current conductor or disconnected therefrom, and, in the embodiment only in the form of a grounding device, can be grounded. When the switching device according to the invention is only designed as a grounding device, the longitudinal connection can then even be connected to the first current conductor, which is arranged at an angle, at a star point which can be grounded.

Further embodiments from the combinations of claims and from the description below and the figures. In all of the figures, the same references also denote functionally identical parts.

DESCRIPTION OF THE DRAWINGS

The invention will be explained below with reference to exemplary embodiments. In the drawings.

APPROACHES TO IMPLEMENTING THE INVENTION

Figure 1:
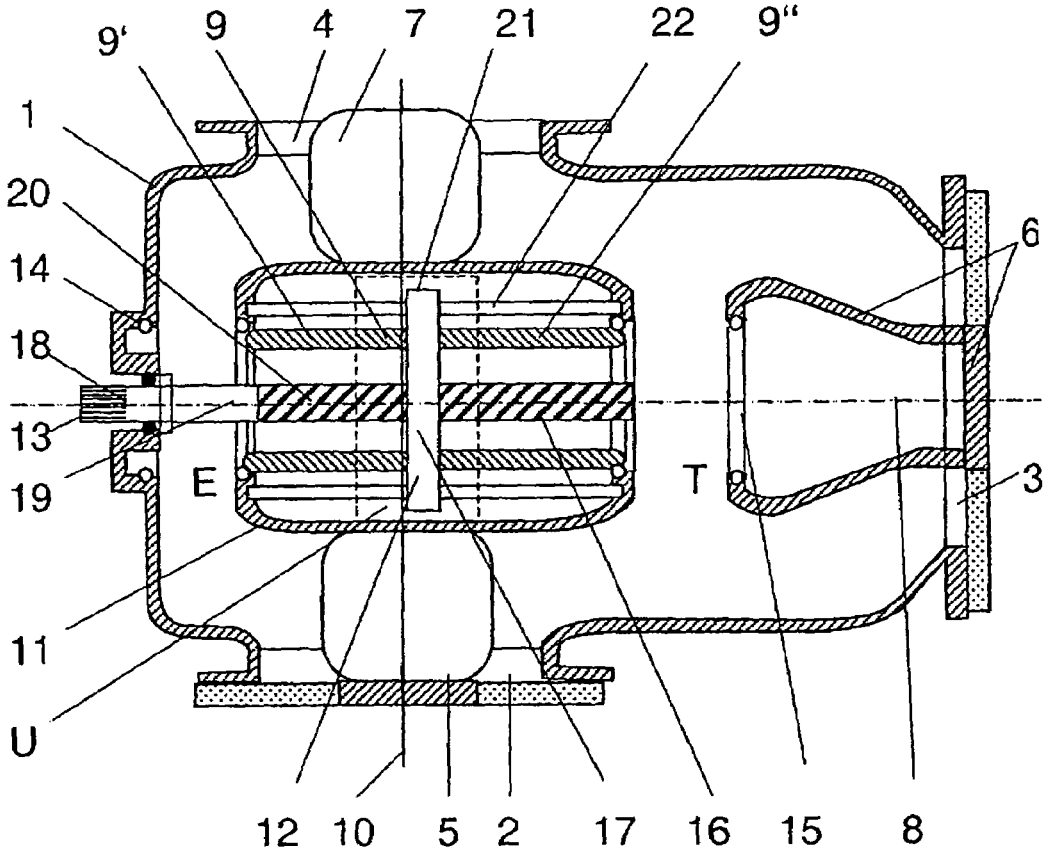
FIG. 1 shows a plan view of a section through a switching device according to the invention, which may be installed in an encapsulated switchgear assembly as a combined disconnecting and grounding switch.

The switching device illustrated in FIG. 1 is in the form of a module of a gas-insulated, metal-encapsulated switchgear assembly and has a metal housing 1 filled with insulating gas and having three openings 2, 3 and 4, which are each delimited by a flange (with no designation). The flanges in each case serve the purpose of making a connection to a mating flange (not illustrated) of an adjacent module of the switchgear assembly. The openings 2 and 3 are each sealed in a gas-tight manner by a barrier insulator (with no designation), which, in a manner which is electrically insulated from the housing 1, in each case supports a current conductor 5 and 6, respectively, which can have a high voltage applied to it. The openings 4 can optionally be sealed in a gas-tight manner by a dummy flange or by a barrier insulator likewise supporting a current conductor 7. Instead of barrier insulators, post insulators with gas passage openings may also be used, if appropriate. An axis 8, which determines the movement direction of a moveable contact element 9 of the switching device, and along which the current conductor 6 is guided from the outside into the interior of the housing 1, is guided centrally through the opening 3. The openings 2 and 4 are opposite one another in the housing 1 such that the current conductor 5 and the possibly provided current conductor 7 are aligned along a line 10, which is guided centrally through the openings. The axis 8 and the line 10 enclose a right angle with one another and therefore determine the geometry of a current path containing the current conductors 5 and 6. A conductor tube 11 or a hollow carrier 11 is fixed so as to conduct current to the current conductor 5 and the possibly provided current conductor 7, said conductor tube 11 or hollow carrier 11 accommodating or engaging around the contact element 9, preferably coaxially surrounding it, and constantly forming a current transfer point with it, irrespective of its position, via two sliding contacts (with no designation).

The contact element 9 of the switching device which can be guided along the axis 8 is fixed and preferably detachably fixed to a retaining element 12. The retaining element 12 is part of a drive 13, which is guided along the axis 8 in a gas-tight manner through the wall of the housing 1, and can be displaced along the axis 8. The at least one contact tube is therefore driven by the retaining element. In a corresponding manner, the position of the contact element 9 is therefore changed. In a first position shown in FIG. 1, the contact element 9 is then electrically conductively connected only to the contact tube 11. In a second position (not visible in FIG. 1), it is displaced to the left and then engages in an electrically conductive manner in a grounding contact 14, which is fixed to the housing 1, possibly in an electrically insulated manner, and coaxially surrounds the drive 13. The switching device then acts as a grounding device E. In a third position which likewise cannot be seen in FIG. 1, the contact element 9 is displaced to the right and then engages in an electrically conductive manner in a disconnector contact 15, which surrounds the contact element 9 and is fixed to the current conductor 6. In this case, the switching device acts as a disconnector T.

The contact element 9 contains two contact tubes 9' and 9", which coaxially surround the axis 8 and can each be detachably connected or are each fixedly connected to the retaining element 12. The retaining element therefore has means for accommodating the two contact tubes. The means may comprise accommodating means or else fixing means. The contact tubes extend from the retaining element 12 to the left (direction of stationary grounding contact 14) or to the right (direction of stationary disconnector contact 15).

Figure 3:
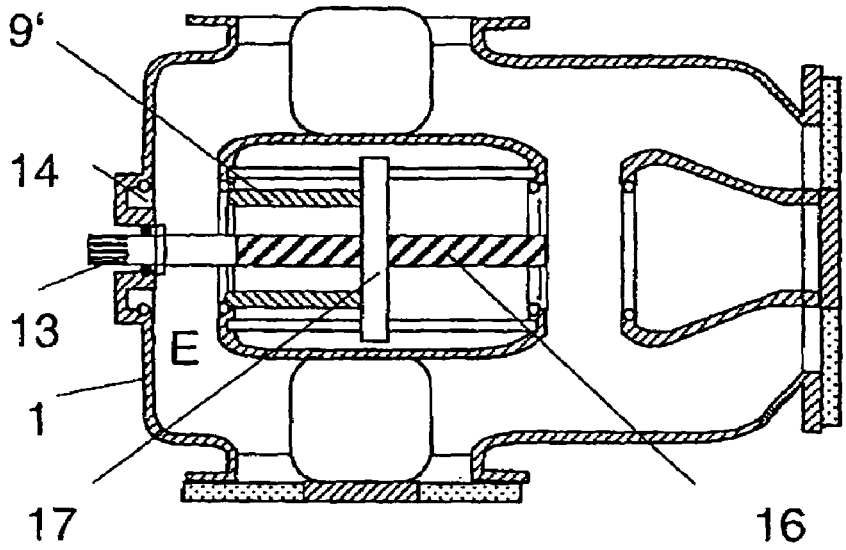
FIG. 3 shows a development of the switching device shown in FIG. 1, which can be installed as a grounding switch in an encapsulated switchgear assembly.
Figure 4:
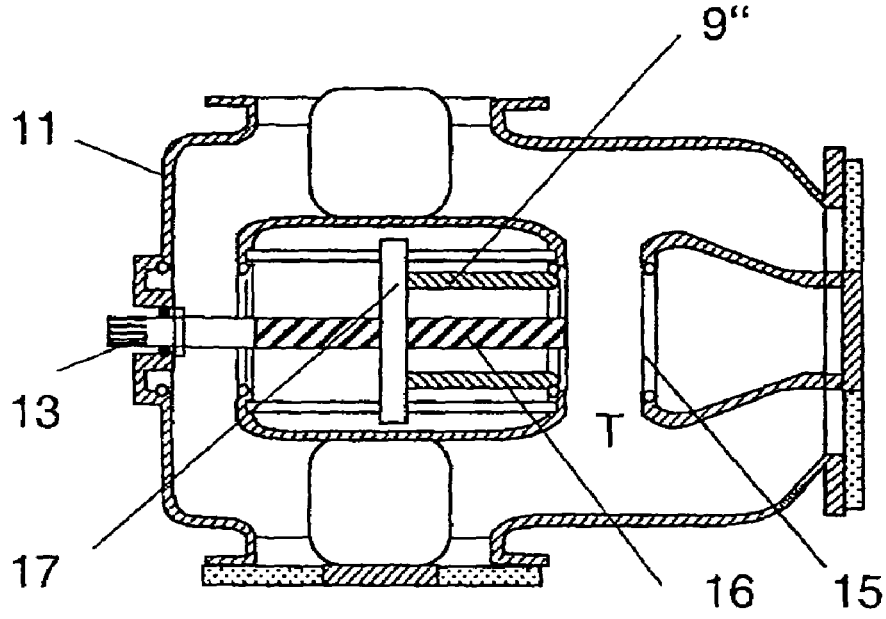
FIG. 4 shows a development of the switching device shown in FIG. 1, which can be installed as a disconnecting switch in an encapsulated switchgear assembly.

Owing to the single drive 13, the functions of the grounding device E and the disconnector T, only the function of the grounding device E once the contact tube 9" has been removed and only the function of the disconnector T once the contact tube 9' has been removed can therefore be performed in a space-saving manner. The switching device can therefore be designed firstly as a combined grounding device E and disconnector T or else only as a simple grounding device E or disconnector T, depending on the intended use in the switchgear assembly. An example of such a simple grounding device E can be seen in FIG. 3, and an example of such a simple disconnector T can be seen in FIG. 4.

Figure 5:
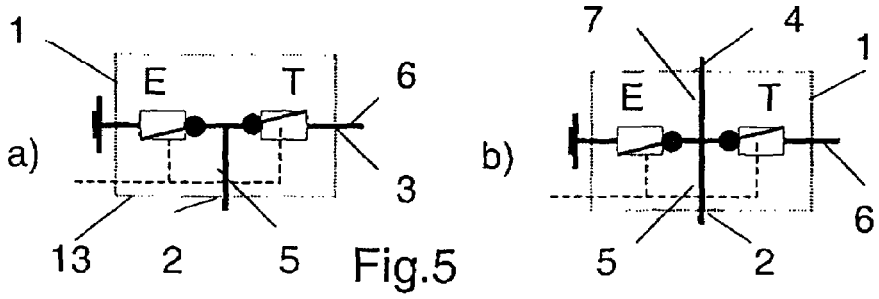
FIG. 5 shows two embodiments of the switching device shown in FIG. 1, which can be installed in the encapsulated switchgear assembly so as to form an angled connection (a) or an angled and longitudinal connection (b)
Figure 6:
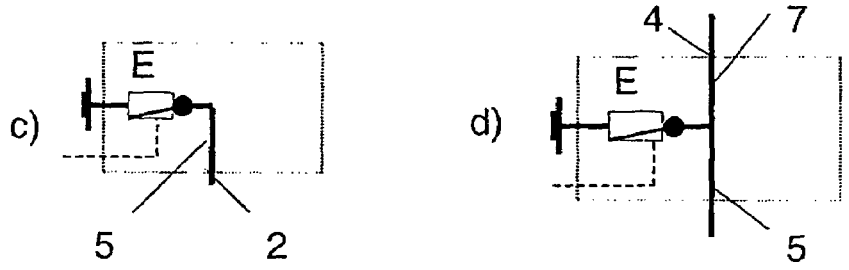
FIG. 6 shows four embodiments of the switching device shown in FIG. 3, which can be installed in the encapsulated switchgear assembly without a current connection (c), so as to form a longitudinal connection (d), an angled connection (e) or an angled and longitudinal connection (f)
Figure 6:
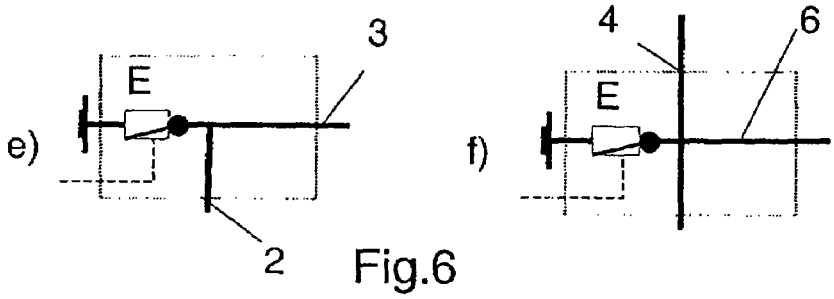
Figure 7:
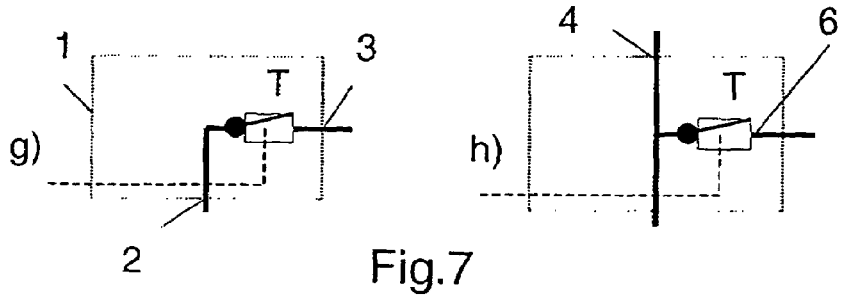
FIG. 7 shows two embodiments of the switching device shown in FIG. 4, which can be installed in the encapsulated switchgear assembly so as to form an angled connection (g) or an angled and longitudinal connection (h).

Owing to the suitable arrangement of the two openings 2 and 3 in the housing 1, in addition to the three functions of grounding and disconnection, only grounding or only disconnection, different connection functions can also be realized, in addition, at the same time for all three types of switching devices. In the case of the switching device shown in FIG. 6*c*), this is shown for a grounding device E, in which no current path is guided through the device and the grounding device E only acts on the current conductor 5 guided through the opening 2. On the other hand, only the angled connection function is achieved with the switching device illustrated in FIG. 5*a*) with the combined grounding device and disconnector function, in which the disconnector T has an angled current path, which is guided through the openings 2, 3 and contains the current conductors 5, 6. Only the angled connection function is also achieved by the grounding device E shown in FIG. 6*e*) or the disconnector T shown in FIG. 7*g*). In these embodiments, in each case one angled current path which can be grounded or disconnected and is likewise guided through the openings 2 and 3 is provided in the housing 1.

At the same time for all three types of switching devices, in addition to the functions of grounding and disconnection, only grounding or only disconnection and the angled connection function, a longitudinal connection function can also be realized through the opening 4. In the case of the combined switching device shown in FIG. 5*b*), the current conductor 7 is guided through the opening 4 and forms a longitudinal connection together with the current conductor 5, which is guided through the opening 2. As can be seen, this longitudinal connection can optionally be grounded, connected to the current conductor 6 via the disconnector T when the grounding device E is open or guided in an insulated manner through the housing when the grounding device E is open and the disconnector T is open. In the case of the grounding device shown in FIG. 6*d*), only the longitudinal connection which can be grounded and is realized by the current conductors 5 and 7 is provided, whereas, in the case of the grounding device shown in FIG. 6*f*), a star point formed by the longitudinal connection and the current conductor 6 and, in the case of the disconnector shown in FIG. 7*h*), the longitudinal connection can be disconnected from or connected to the current conductor 6 which is arranged at an angle with respect thereto.

In principle, the drive 13 of the moveable contact element 9 may comprise a push rod, which is guided through the wall of the housing 1, and a lever since, by these means, it is possible for the contact element 9 to be displaced. For reasons of saving space, however, it is recommended to displace the contact element 9 via a spindle gear, which is integrated in the drive and has a threaded spindle 16, which is guided axially and centrally through the grounding contact 14, and a spindle nut 17 supporting or forming the retaining element 12 (FIG. 1). The threaded spindle 16 has three mutually adjacent sections 18, 19 and 20. The section 19 consists of an insulating material and therefore insulates the metal section 18, which is guided through the wall of the housing 1 and is mounted such that it can rotate in the grounding contact 14, from the section 20. The section 20 supports an outer thread interacting with the spindle nut 17. Three sliding elements 21, which each interact with one of three guide rails 22 aligned axially in the conductor tube 11, are provided at the outer edge of the retaining element 12. The sliding elements 21 and correspondingly also the guide rails are distributed evenly in the circumferential direction (only two of the three sliding elements 21 or rails 22 can be seen in FIG. 1).

The actuation of the moveable contact element in the case of a switching operation takes place by means of a rotation of the threaded spindle 16 which is introduced outside the housing 1 at the section 18. Torque is now transmitted via the insulating central section 19 to the thread provided in the section 20 and converted into a longitudinal movement of the contact element 9 via the spindle nut 17. The threaded spindle 16 is mounted unsupported since the spindle 16 is axially guided by the spindle nut 17. In this case, the sliding elements 21 slide along the guide rails 22 and therefore prevent any concomitant rotation of the spindle nut 17. With corresponding drive control, the moveable contact element 9 can be moved in a simple manner into each of the three positions: grounding device E "on" and disconnector T "off", grounding device E and disconnector T "off" (neutral position) or grounding device E "off" and disconnector T "on".

Although one or two sliding elements 21 and the corresponding number of guide rails 22 already prevent any concomitant rotation of the spindle nut 17, it has proven to be expedient to provide three or possibly even more sliding elements and guide rails. Precise and secure guidance or radial securing of the contact element 9, which is subjected to severe forces on actuation of the switching device, is thereby achieved.

Figure 2:
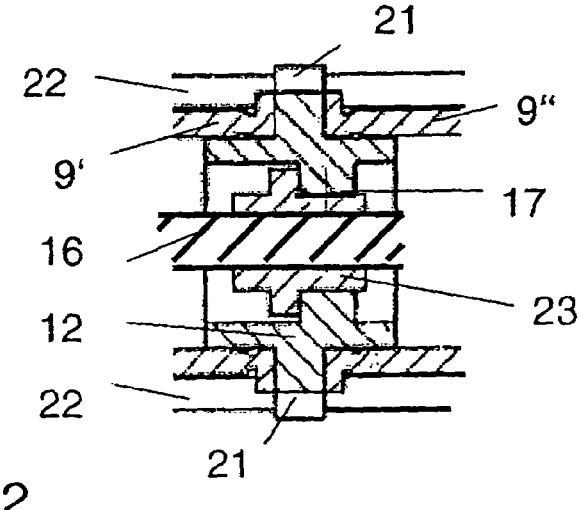
FIG. 2 shows a detailed illustration of a region U marked out in FIG. 1 by a border.

As can be seen in FIG. 2, the spindle nut 17 is formed by a threaded nut 23 and the retaining element 12. The retaining element 12 is in the form of a supporting ring and is fixed at the outer edge of the threaded nut 23, for example by means of a screw connection. The contact tubes 9' and 9" of the moveable contact element 9 are fixed detachably to the retaining element 12, for example by means of screwing.

LIST OF REFERENCES

1 Encapsulating housing
2,3,4 Openings
5,6,7 Current conductors
8 Axis
9 Contact element
9',9" Contact tubes
10 Line
11 Conductor tube
12 Retaining element
13 Drive
14 Grounding contact
15 Disconnector contact
16 Threaded spindle
17 Spindle nut
18,19,20 Spindle sections
21 Sliding element
22 Guide rail
23 Threaded nut
E Grounding device
T Disconnector

The invention claimed is:

1. A switching device configurable to have disconnection and grounding functions, comprising:
- an encapsulating housing filled with insulating gas;
- a stationary grounding contact fixed to the housing;
- a stationary disconnector contact fixed to a first current conductor, to which a high voltage is applicable;
- a moveable contact element movable along an axis and engagable with at least one of the grounding contact and the disconnector contact;
- a conductor tube fixed to a second current conductor, to which a high voltage is applicable, said conductor tube accommodating the moveable contact element so as to form a current transfer point; and
- a drive, which is guided through the housing and drives the moveable contact element with force, wherein:
  - a) the drive has a retaining element movable along the axis and is guided in the conductor tube, and
  - b) the retaining element accommodates two contact tubes, of which a first contact tube forms a mating contact of a grounding device containing the stationary grounding contact, and a second contact tube forms a mating contact of a disconnector containing the disconnector contact,
- and wherein the switching device is configurable as purely a grounding device, purely a disconnecting device, and a combined disconnecting/grounding device,
  - a) said switching device being configured as the grounding device when the contact element contains only the first contact tube,
  - b) said switching device being configured as the disconnecting device when the contact element contains only the second contact tube, and
  - c) said switching device being configured as the disconnecting/grounding device when the contact element contains the first contact tube and the second contact tube.

2. The switching device as claimed in claim 1, wherein at least one of the contact tubes is driven by the retaining element.

3. The switching device as claimed in claim 1, wherein at least one of the contact tubes is detachably connected to the retaining element.

4. The switching device as claimed in claim 1, wherein the retaining element is guided axially in the conductor tube and secured radially.

5. The switching device as claimed in claim 1, wherein the drive is a spindle gear.

6. The switching device as claimed in claim 5, wherein the spindle gear has a threaded spindle, which is guided axially and centrally through the grounding contact, and has a spindle nut, which supports and/or forms the retaining element.

7. The switching device as claimed in claim 6, wherein the spindle nut is formed by a threaded nut and the annular retaining element, which is fixed at the outer edge of the threaded nut.

8. The switching device as claimed in claim 5, wherein a sliding element is arranged at an outer edge of the retaining element and interacts with a guide rail, which is aligned axially in the conductor tube.

9. The switching device as claimed in claim 8, wherein, in addition to the one sliding element, at least two further sliding elements are also arranged evenly distributed in the circumferential direction at the outer edge of the retaining element, which further sliding elements interact with a corresponding number of guide rails which are aligned axially in the conductor tube.

10. The switching device as claimed in claim 1, wherein the housing has two openings, including:

a first opening having the axis passing through it and leading through the first current conductor, and a second opening arranged at an angle with respect to the axis and leading through the second current conductor, wherein the switching device is adapted to provide a fourth configuration based on access to the first conductor or the second conductor via the first opening or the second opening, respectively, said fourth configuration including one of the grounding device configuration, the disconnecting device configuration, and the combined disconnecting/grounding device configuration.

11. The switching device as claimed in claim 10, wherein the housing has a third housing opening, which leads through a third current conductor, which is arranged in line with the second current conductor and can have a high voltage applied to it, such that a longitudinal connection of the switchgear assembly is guided through the switching device.

12. The switching device as claimed in claim 2, wherein at least one of the contact tubes is detachably connected to the retaining element.

13. The switching device as claimed in claim 12, wherein the retaining element is guided axially in the conductor tube and secured radially.

14. The switching device as claimed in claim 13, wherein the drive is a spindle gear.

15. The switching device as claimed in claim 1, wherein the housing has two openings, including:

a first opening having the axis passing through it and leading through the first current conductor, and a second opening arranged at an angle with respect to the axis and leading through the second current conductor.

16. A switching device configurable to have disconnection and grounding functions, comprising:

an encapsulating housing filled with insulating gas;

a first stationary contact fixed to the housing;

a second stationary contact fixed to a first current conductor;

a moveable contact element movable along an axis to selectively engage at least one of the two stationary contacts;

a conductor tube fixed to a second current conductor to accommodate the moveable contact element and form a current transfer point;

a drive which is guided through the housing and configured to drive the moveable contact element; and a retaining element of the drive which is movable along the axis and is guided in the conductor tube, the retaining element being configured to accommodate two contact tubes, of which a first contact tube forms a mating contact of a grounding device containing the first stationary contact, and a second contact tube forms a mating contact of a disconnector containing the second stationary contact, wherein the moveable contact element contains at least one of the two contact tubes, and wherein the switching device is configurable as purely a grounding device, purely a disconnecting device, and a combined disconnecting/grounding device, a) said switching device being configured as the grounding device when the contact element contains only the first contact tube, b) said switching device being configured as the disconnecting device when the contact element contains only the second contact tube, and c) said switching device being configured as the disconnecting/grounding device when the contact element contains the first contact tube and the second contact tube.

17. The switching device as claimed in claim 16, wherein the at least one contact tube is driven by the retaining element.

18. The switching device as claimed in claim 16, wherein the at least one of the contact tubes is detachably connected to the retaining element.

19. The switching device as claimed in claim 16, wherein the housing has two openings, including:

a first opening having the axis passing through it and leading through the first current conductor, and a second opening arranged at an angle with respect to the axis and leading through the second current conductor, wherein the switching device is adapted to provide at least a fourth configuration based on access to the first conductor or the second conductor via the first opening or the second opening, respectively, said fourth configuration including one of the grounding device configuration, the disconnecting device configuration, and the combined disconnecting/grounding device configuration.

20. The switching device as claimed in claim 1, wherein the first contact tube extends leftward from the retaining element in the direction of the stationary grounding contact, and the second contact tube extends rightward in the direction of the stationary disconnector contact.

21. The switching device as claimed in claim 16, wherein the first contact tube extends leftward from the retaining element in the direction of the stationary grounding contact, and the second contact tube extends rightward in the direction of the stationary disconnector contact.

22. The switching device as claimed in claim 10, wherein in the case the switching device is configured as the grounding device, the grounding device only acts on a current conductor guided through the second opening.

23. The switching device as claimed in claim 10, wherein an angled current path, which is guided through the openings and which can be grounded or disconnected, is provided in the housing.

24. The switching devices as claimed in claim 11, wherein the longitudinal connection, in the case of the combination disconnector, is connectable to or disconnectable from the first current conductor guided at an angle thereto, or can be grounded.

25. The switching device as claimed in claim 11, wherein the longitudinal connection, in the case the switching device is configured as the grounding device, can be grounded.

26. The switching device as claimed in claim 25, wherein the longitudinal connection is connected to the first current conductor, which is arranged at an angle, and thus forms a star point which can be grounded.

* * * * *